US005139201A

United States Patent [19]

De Laforcade

[11] Patent Number: 5,139,201

[45] Date of Patent: Aug. 18, 1992

[54] PUSH-BUTTON FOR AEROSOL CAN, AND AEROSOL CAN PROVIDED WITH A PUSH-BUTTON OF THIS KIND

[75] Inventor: Vincent De Laforcade, Clamart, France

[73] Assignee: L'Oreal, Paris, France

[21] Appl. No.: 674,087

[22] Filed: Mar. 25, 1991

[30] Foreign Application Priority Data

Apr. 3, 1990 [FR] France ..... 90 04247

[51] Int. Cl.[5] ..... B05B 7/32

[52] U.S. Cl. ..... 239/343; 239/590; 222/402.1

[58] Field of Search ..... 239/338, 343, 370, 337, 239/590; 222/402.1, 402.24

[56] References Cited

U.S. PATENT DOCUMENTS

| | | | |
|---|---|---|---|
| 3,077,307 | 2/1963 | Moore et al. | 239/338 |
| 3,236,458 | 2/1966 | Ramis | 239/370 |
| 3,534,771 | 10/1970 | Eyerdam | 239/337 |
| 4,116,387 | 9/1978 | Kremer, Jr. et al. | 239/370 |
| 4,394,289 | 4/1983 | Brown et al. . | |
| 4,512,341 | 4/1985 | Lester | 239/338 |
| 4,560,519 | 12/1985 | Cerny | 239/338 |
| 4,566,452 | 1/1986 | Farr | 239/338 |
| 4,588,129 | 5/1986 | Shanks | 239/370 |
| 4,901,925 | 2/1990 | Blake, III | 239/370 |

FOREIGN PATENT DOCUMENTS

| | | | |
|---|---|---|---|
| 0322488 | 5/1989 | European Pat. Off. . | |
| 577048 | 5/1933 | Fed. Rep. of Germany | 239/590 |
| 2227690 | 8/1990 | United Kingdom | 239/338 |

*Primary Examiner*—Andres Kashnikow
*Assistant Examiner*—Christopher G. Trainor
*Attorney, Agent, or Firm*—Cushman, Darby & Cushman

[57] ABSTRACT

The push-button (1) is intended for an aerosol can (B) containing a mousse, in particular a hair styling mousse, this can (B) being provided with a delivery valve (2) capable of being actuated by the push-button (1). This push-button comprises a duct (4) leading towards the exterior for the delivery of the product and adapted to be connected to the valve (2), a deflector (6) being provided across the extension of the delivery duct (4) in order to start the expansion of the mousse before it emerges from the push-button (1). The deflector (6) is in the form of a cap (7), the concave part of which is directed towards the outlet of the duct (4), the end part of the duct being surrounded by a wall (9) defining a chamber (10), the base (11) of which is recessed relative to the opening of the duct (4) and the open end (12) of which is situated above the cap (7).

10 Claims, 1 Drawing Sheet

PUSH-BUTTON FOR AEROSOL CAN, AND AEROSOL CAN PROVIDED WITH A PUSH-BUTTON OF THIS KIND

The invention relates to a push-button for an aerosol can containing a mousse, in particular a hair styling mousse, this can being provided with a delivery valve capable of being actuated by the push-button, said push-button comprising a duct leading to the exterior for the delivery of the product and adapted to be connected to the valve, a deflector being provided across the extension of the delivery duct in order to start the expansion of the mousse before it emerges from the push-button.

It is clear that the quality level of the product delivered, i.e. the mousse, requires improvement, particularly in the case of aerosol cans having a plunger tube, and adapted to be held upright for use.

Therefore, the object of the invention is to provide a push-button of the type described hereinbefore which in addition to satisfying the usual requirements of economic manufacture and rapid assembly, also makes it possible to deliver a mousse of better quality, particularly from the moment delivery of this mousse begins.

According to the invention, a push-button for an aerosol can of the type described hereinbefore is characterised in that the deflector is in the form of a cap, the concave part of which is directed towards the outlet of the duct so as to cover it, the end part of the duct being surrounded by a wall defining a chamber, the base of which is recessed relative to the opening of the duct and the open end of which is situated above the cap. The outflowing product must therefore make two changes of direction, each of substantially 180°.

The cap is preferably hemispherical.

The chamber surrounding the end part of the duct can be in the shape of a rectangular parallelepiped. The cap advantageously forms part of an end fitting having an outer surface corresponding in shape to the inner surface of the chamber, the large faces of the end fitting being substantially tangential to the outer surface of the cap, while the small faces of the end fitting are at a distance from either side of the cap.

The chamber is preferably disposed in such a way that its large faces are perpendicular to the axis of the aerosol can when the push-button is fitted to this can.

The delivery duct is generally directed at a right angle relative to the axis of the push-button, a tube coaxial with this axis and communicating with the delivery duct being capable of acting on the valve via its lower part.

The aerosol can containing a mousse provided with a push-button of this kind is generally of the type having a plunger tube so that it can be used held upright. The delivery valve is generally a female valve, the coaxial tube of the push-button penetrating into the valve in order to actuate it.

The push-button is preferably hooked on to a hoop, itself fixed to the rim of the valve. The push-button is hooked on to the hoop by means of at least two elastic snap-engagement fastening hooks provided in a cylindrical skirt engaged so that it can be slidably guided in a collar of sufficient axial length provided on the hoop. The latter forms a type of dome which is adapted to cover the rim of the valve and comprises in its interior a cylindrical portion having a diameter greater than that of the guide collar of the push-button adapted to be fitted by means of snap engagement to the rim of the valve by virtue of an internal annular projection.

In addition to the arrangements described hereinabove, the invention consists of a number of other arrangements which will be discussed in more detail hereinafter with reference to one embodiment which is in no way limiting and which is described with reference to the accompanying drawings, in which.

Figure 1:
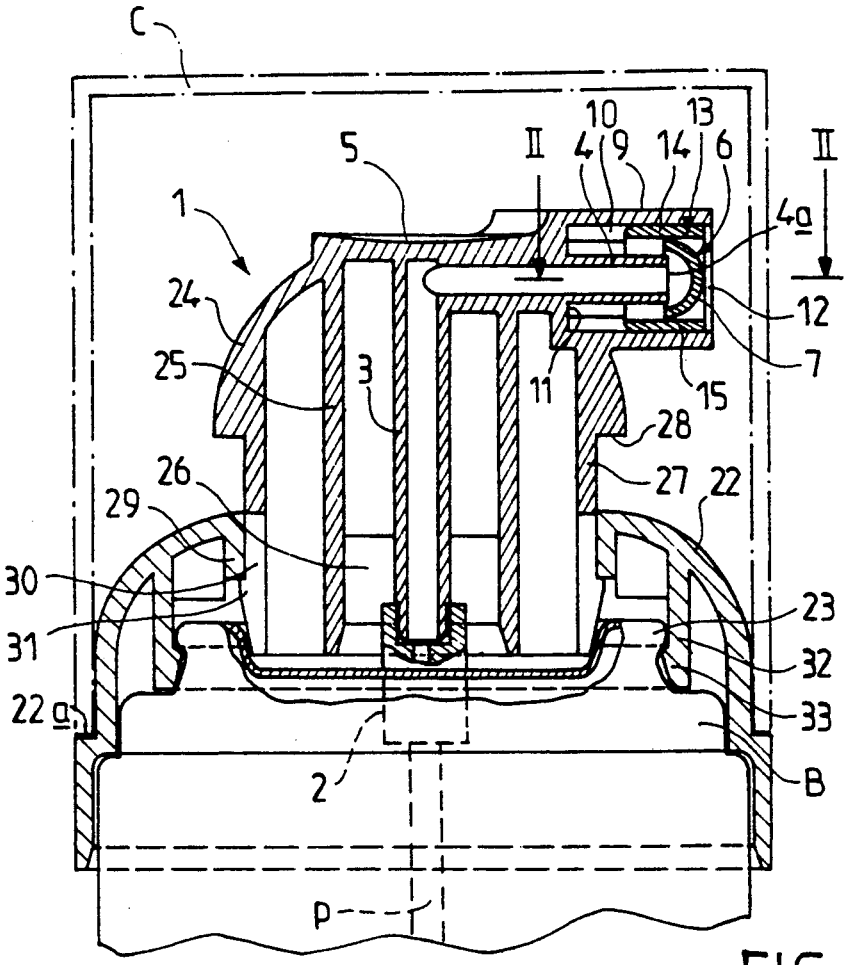
FIG. 1 is a vertical section, passing through the axis of the delivery duct, of a push-button according to the invention.

Referring to the drawings, especially to FIG. 1, they show a push-button 1 for an aerosol can B, shown in part, containing a mousse, in particular a hair styling mousse. The can B is provided with a delivery valve 2. The can B is of the type having a plunger tube p so that it can be used held upright. The delivery valve 2 is a female valve which can be engaged by a tube 3 coaxial with the push-button 1 in order to actuate the valve and establish a connection in order to direct the product towards a duct 4 leading to the exterior for the delivery of this product. This duct 4 is perpendicular to the tube 3, with which it communicates in its upper part. When the axis of the can B is vertical, the duct 4 is horizontal.

The upper wall of the button 1 comprises a slightly concave surface 5 surmounting the tube 3, in order to allow the user to exert vertical pressure on the button 1 in order to actuate the valve 2.

A deflector 6 is provided across the extension of the delivery duct 4 in order to start the expansion of the mousse before it emerges from the push-button 1. This deflector 6 is in the form of a cap 7, in particular a spherical cap, the concave part of which is directed towards the outlet of the duct 4 so as to cover it. However, the inner surface of the cap 7 is at a distance from the end of the duct 4, as is clear in FIG. 2, in order to leave an annular passage 8 for the product.

The end part of the duct 4 is surrounded by a wall 9 forming an integral part of the button 1 and defining a chamber 10, the base 11 of which is recessed relative to the opening 4*a* of the duct 4 and the open end 12 of which is situated above the cap 7.

Figure 3:
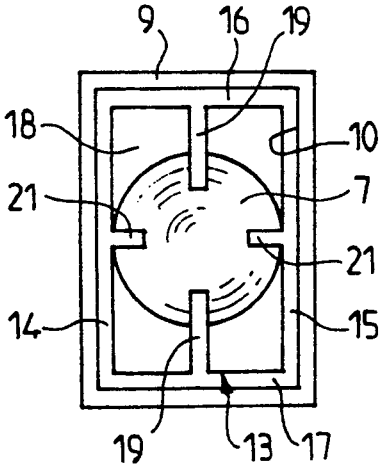
FIG. 3 is a view of the right-hand portion of FIG. 2.

The cap 7 is preferably hemispherical and centered on the axis of the duct 4. The equatorial base plane of the cap 7 is perpendicular to this axis. The chamber 10 is in the shape of a rectangular parallelepiped, as can be seen in FIG. 3. The cap 7 forms part of an end fitting 13, preferably moulded of plastic material, having an outer surface in the shape of a rectangular parallelepiped corresponding in shape to the inner surface of the chamber 10. This end fitting 13 is open at its two faces perpendicular to the axis of the duct 4. The large lateral faces 14, 15 of the end fitting 13 are perpendicular to the axis of the tube 3 and therefore to the axis of the can when the button 1 is fitted to this can B. The large faces 14, 15 are substantially tangential to the outer surface of the cap 7, as can be seen in FIGS. 1 and 3, while the small faces 16, 17 of the end fitting are at a distance from either side of the cap 7 so as to leave passages 18 for the delivery of the product.

Figure 2:
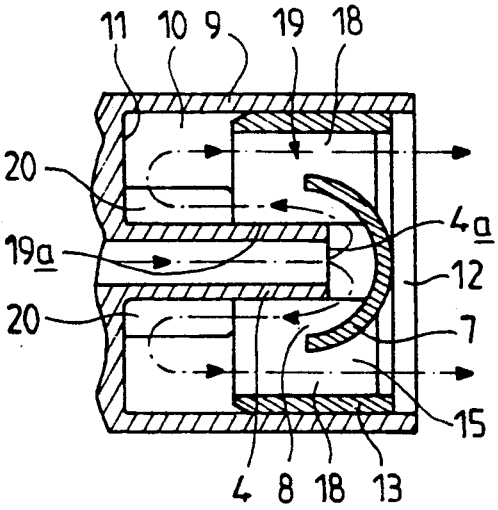
FIG. 2 is a part section along the line II—II of FIG. 1, on a larger scale, and finally

Two diametrically opposing radial walls 19 forming an integral part of the end fitting 13 ensure a connection between the cap 7 and the central zone of the small faces 16, 17 of the end fitting. These walls 19 are relatively narrow and their internal radial portions 19*a* are situated at a distance from the axis equal to the outer radius of the duct 4 so that the portions 19*a* of the walls 19 are fitted to this outer surface, as can be seen in FIG. 2.

The chamber 10 comprises, starting from the base 11, shoulders 20, the walls 19 being capable of resting axially against these shoulders. Two diametrically opposing walls 21 of smaller radial dimensions ensure a connection between the cap 7 and the central zone of the large faces 14, 15.

The end fitting 13 can be held in the chamber 10 by means of a snap fitting, or may be glued or welded, or fixed by any other appropriate means. The push-button 1 is hooked on to a hoop 22, itself fixed to the rim 23 of the valve, formed by a circular collar.

At rest, a protective cap C of cylindrical shape covers the push-button 1, the base of the cap C coming to rest against a shoulder 22*a* of the hoop 22.

The push-button 1 comprises on its exterior a sort of dome 24, in the interior of which is provided a cylindrical sleeve 25, coaxial with the tube 3, but having a larger diameter, surrounding this tube from the upper part of the button 1 to towards the bottom. Radially directed walls 26 ensure a star connection between the lower end of the tube 3 and the sleeve 25.

A skirt 27 extends the dome 24 towards the bottom, by way of a recess 28. This cylindrical skirt 27, of a diameter greater than that of the sleeve 25, is engaged so that it can be slidably guided in a collar 29 of sufficient axial length provided on the hoop 22. At least two diametrically opposing elastic fastening hooks 30 are defined in the cylindrical wall of the skirt 27 by two rectilinear slots, along generatrices. These fastening hooks 30 display radial elasticity and are provided on their exterior with a projection 31 capable of hooking under the lower rim of the collar 29.

The hoop 22 forms a sort of dome adapted to cover the rim 23 and comprises in its interior a cylindrical portion 32 having a diameter greater than that of the collar 29, capable of being fitted by means of snap engagement to the collar 23 by virtue of an internal annular projection 33. The push-button is used and operated as follows:

By pressing on the surface 5, the user causes the button to be pressed down into the hoop 22 and the valve 2 is depressed by the tube 3. The valve 2 opens and the product emerges through the tube 3 and the duct 4, as illustrated by the arrows in FIG. 2.

The combination of the cap 7 and the chamber 9 imposes a double change of direction on the flow of the product, each time of substantially 180°. This results in improved quality of the mousse, particularly at the beginning of delivery.

Although this result is surprising, it can be explained as follows:

When the aerosol can is left at rest for a certain period of time, e.g. between use from one morning to the next, the liquid fraction of the product is of course located at the bottom of the can B and the gas in suspension rises to the surface. The contents of the can are thus separated into two phases: a liquid phase and a gaseous phase.

This separation into two phases is also produced in the plunger tube p. As the section of this tube p is small, the shaking of the can B generally effected before use is not sufficient to emulsify completely the two phases contained therein. Therefore, opening of the valve 2 will result firstly in the delivery of a small quantity of gas, then a mixture containing too much gas, and then mousse of a quality level identical to that desired. By virtue of the semi-spherical obstacle created by the cap 7, when the valve 2 is opened, the spray, particularly of gas, is returned towards the base 11 of the chamber 9 where it rebounds upon a flat wall before it can be directed towards the delivery passages 18 of the push-button. During this course, the spray, particularly of gas, is immersed within the flow of mousse which continues to emerge in the opposite direction and absorbs it.

The push-button 1, which is moved axially from top to bottom (and conversely), is well guided by the collar 29, this being advantageous for the reasons indicated hereinafter.

It has been found that in order to remove the protective cap C covering the push-button ; at rest, the users of aerosol cans generally perform a movement consisting in rotating the cap C laterally relative to the large axis of the can. The push-button 1 must therefore not be too high and its part closest to the cap C at rest must be at a sufficient distance so that the cap C, when removed, does not take the push-button along with it.

By virtue of the push-button 1 being hooked on to the hoop 22 according to the invention, the push-button 1 is free to move in the axial direction in such a manner that it cannot come out of its housing, and it is prevented from moving in the lateral direction by the guide collar 29.

Therefore, even if the cap C comes to rest against the push-button 1 when rotated, it cannot carry the push-button along with it as said push-button is firmly held. It is therefore possible to reduce substantially the minimum distance between the push-button 1 and the inner face of the cap C at rest without reducing the wearing characteristics of the push-button 1. This substantially increases the choice of forms for the aerosol appliance.

I claim:

1. A push button apparatus for an aerosol can containing a mousse, in particular a hair styling mousse, and being provided with a delivery valve capable of being actuated by the push-button apparatus, the push-button apparatus comprising:

a delivery duct with a first end being adapted to receive the mousse from the delivery valve and a second end;

a deflector for enabling the mousse to expand before emerging from the push-button apparatus, said deflector being located across said second end of the delivery duct and being in the form of a cap with an inner concave surface and an outer surface, the inner concave surface facing said second end of the delivery duct so as to cover said second end, said cap being located at a distance from the second end of the delivery duct so as to leave an annular passage for the mousse; and a wall surrounding said second end of the delivery duct and the deflector, said wall defining a chamber with a base and an open end, the base being recessed relative to the second end of the delivery duct and the open end of said chamber being located beyond the deflector so as to facilitate release of the mousse from the push-button apparatus.

2. A push button apparatus according to claim 1, characterised in that the deflector is hemispherical.

3. A push button apparatus according to claim 1 or claim 2, characterised in that the chamber surrounding the second end of the delivery duct is in the shape of a rectangular parallelepiped.

4. A push button apparatus according to claim 3, characterised in that the deflector forms part of an end fitting having an outer surface with large and small faces, corresponding in shape to the chamber, the large faces of the end fitting being substantially tangential to the outer surface of the deflector, while the small faces of the end fitting are at a distance from either side of the deflector.

5. A push button apparatus according to claim 4, characterised in that the chamber is disposed in such a way that the large faces of the end fitting are perpendicular to a vertical axis of the aerosol can when the push-button apparatus is fitted to this can.

6. A push button apparatus according to claim 1, wherein said push-button apparatus has a longitudinal axis and characterised in that the delivery duct is directed at a right angle relative to said longitudinal axis of the push-button apparatus, and that a tube coaxial with this axis is provided, communicating with the delivery duct, and is capable of acting on the valve via its lower part.

7. A push button apparatus according to claim 1, characterised in that the push-button apparatus is attached onto a hoop, which is fixed to a rim of the valve.

8. A push button apparatus according to claim 7, characterised in that attachment to the hoop is ensured by means of at least two elastic snap-engagement fastening hooks provided on a cylindrical skirt which can be slidably guided in a collar, of sufficient axial length, provided on the hoop.

9. A push button apparatus according to claim 8, characterised in that the hoop forms a type of dome which is adapted to cover the rim of the valve and comprises in its interior a cylindrical portion having a diameter greater than that of the collar and being adapted to be fitted by means of snap engagement to the rim of the valve by virtue of an internal annular projection.

10. An aerosol can containing a mousse, of the type comprising a plunger tube so as to be held upright for use, characterised in that it is provided with a push-button apparatus according to claim 1.

* * * * *